US005488822A

United States Patent [19]

Meier

[11] Patent Number: 5,488,822

[45] Date of Patent: Feb. 6, 1996

[54] CURVED FIBER GUIDE CHANNEL FOR AN OPEN-END SPINNING APPARATUS

[75] Inventor: Wolfgang Meier, Jüchen, Germany

[73] Assignee: W. Schlafhorst AG & Co., Moenchengladbach, Germany

[21] Appl. No.: 90,593

[22] Filed: Jul. 12, 1993

[30] Foreign Application Priority Data

Jul. 11, 1992 [DE] Germany ..... 42 22 840.9

[51] Int. Cl.[6] ..... D01H 4/00

[52] U.S. Cl. ..... 57/413; 57/406; 57/407; 57/408

[58] Field of Search ..... 57/408, 413, 406, 57/407, 411

[56] References Cited

U.S. PATENT DOCUMENTS

| | | | |
|---|---|---|---|
| 3,411,283 | 11/1968 | Isomura | 57/407 X |
| 3,538,698 | 11/1970 | Ripka et al. | 57/413 |
| 3,672,144 | 6/1972 | Didek et al. | 57/413 |
| 4,245,460 | 1/1981 | Staufert et al. | 57/407 X |
| 4,567,723 | 2/1986 | Safar | 57/413 X |
| 4,858,423 | 8/1989 | Stahlecker | 57/413 |
| 4,879,873 | 11/1989 | Kawabata et al. | 57/408 X |

FOREIGN PATENT DOCUMENTS

| | | | |
|---|---|---|---|
| 267376 | 12/1968 | Austria . | |
| 7820853 | 7/1978 | Germany . | |
| 2119571 | 11/1980 | Germany . | |
| 3636182 | 4/1988 | Germany . | |
| 3922877 | 2/1990 | Germany | 57/413 |
| 60-119230 | 6/1985 | Japan . | |
| 570474 | 12/1975 | Switzerland . | |
| 2204603 | 11/1988 | United Kingdom | 57/413 |

*Primary Examiner*—William Stryjewski
*Attorney, Agent, or Firm*—Herbert L. Lerner; Laurence A. Greenberg

[57] ABSTRACT

An open-end spinning apparatus includes a feed device for supplying sliver; a device downstream of the feed device for separating the sliver into individual fibers; a fiber guide channel downstream of the fiber separating device for pneumatically transferring the individual fibers; a spinning rotor downstream of the fiber guide channel for rotating in a given direction and receiving the individual fibers, the spinning rotor having a fiber slide wall with a given radius of curvature; and a lid closing the spinning rotor and having a centrally disposed yarn draw-off tube and a lid extension. The fiber guide channel has an end region extending in the lid extension and being curved in the given direction. The end region has an orifice region disposed in the lid extension. The orifice region is a curved channel segment being closed on all sides and terminating in a small orifice, and the orifice region has a radius of curvature being matched to the given radius of curvature.

11 Claims, 3 Drawing Sheets

CURVED FIBER GUIDE CHANNEL FOR AN OPEN-END SPINNING APPARATUS

BACKGROUND OF THE INVENTION

1. Field of the Invention

The invention relates to an open-end spinning apparatus with a feed device for supplying sliver, a device for separating the sliver into individual fibers, a fiber guide channel for pneumatically transferring the individual fibers to a spinning rotor, and a lid with a centrally disposed yarn draw-off tube for closing the spinning rotor, an end region of the fiber guide channel extending in the lid extension is constructed in such a way as to be curved in the direction of rotor rotation.

In order to be able to produce open-end yarns of good quality, certain peripheral conditions must be met in terms of the mutual configuration and dimensioning of the spinning elements. For instance, the spinning rotor, the fiber guide channel, the lid closing the spinning rotor, and the yarn draw-off tube must be adapted to one another.

It has been found that the structure of the fiber guide channel, especially, has a considerable influence on the yarn quality which is attainable.

In the past, various attempts have already been made to find an optimal structure of the fiber guide channel. In the process it was found that the structure of the orifice region of such fiber guide channels in particular has a considerable influence on the yarn quality which is attainable.

German Petty Patent GM 78 20 853, for instance, discloses an open-end spinning apparatus having a fiber guide channel which has a substantially rectilinear course. The fiber channel ends at the cylindrical periphery of a lid extension protruding into the spinning rotor. The individual fibers that are combed out by a yarn separating roller in that configuration are fed directly, without any special deflection, onto the fiber slide wall of the spinning rotor and in the process are curved considerably or intermingled by the air stream revolving in the spinning rotor. The fibers can then no longer be adequately straightened out along their relatively short path to the fiber collecting groove of the spinning rotor, and therefore the yarn qualities attainable in such spinning equipment cannot be satisfactory.

German Published, Prosecuted Application DE 21 19 572 describes an open-end spinning apparatus with a fiber guide channel constructed in curved fashion in its end region. The fiber guide channel ends, as usual, in a lid extension protruding into the spinning rotor and has an orifice region that for the most part is open. The inner side wall of the fiber guide channel is constructed in such a way as to be curved in the rotor rotation direction in the orifice region.

A similar spinning apparatus is also known from Published Japanese Application 60-119230. That patent application describes various variants of a possible embodiment of the orifice region of a fiber guide channel. The numerous drawings show orifice regions by way of example in which either the inner or outer external wall is curved in the direction of rotor rotation. Variants are also shown in which both side walls are curved in the rotor rotation directions. The orifice region of the fiber guide channel in that case forms a large outlet opening that widens in delta-like fashion.

Austrian Patent 267 376 also discloses constructing the fiber guide channel as a fiber delivery tube with a streamlined, teardrop-shaped cross section. The part of that yarn delivery tube that curves spirally in the direction of rotor rotation comes to a sharp-pointed end in the end region. Also disposed in that end region of the fiber delivery tube is the fiber outlet opening, which is constructed as a longitudinal slit that comes to a point at the end.

While the transition of the individual fibers emerging from the fiber guide channel onto the slit wall of the spinning rotor is improved through the use of the systems described above, the problem of fiber turbulence in that region is nevertheless not adequately overcome.

SUMMARY OF THE INVENTION

It is accordingly an object of the invention to provide an open-end spinning apparatus, which overcomes the hereinafore-mentioned disadvantages of the heretofore-known devices of this general type and which is suitable for producing open-end spinning yarns of higher quality. In particular, the apparatus should make it possible to produce yarns with increased strength values.

With the foregoing and other objects in view there is provided, in accordance with the invention, an open-end spinning apparatus, comprising a feed device for supplying sliver; a device downstream of the feed device for separating the sliver into individual fibers; a fiber guide channel downstream of the fiber separating device for pneumatically transferring the individual fibers; a spinning rotor downstream of the fiber guide channel for rotating in a given direction and receiving the individual fibers, the spinning rotor having a fiber slide wall with a given radius of curvature; and a lid closing the spinning rotor and having a centrally disposed yarn draw-off tube and a lid extension; the fiber guide channel having an end region extending in the lid extension and being curved in the given direction, the end region having an orifice region disposed in the lid extension, the orifice region being a curved channel segment being closed on all sides and terminating in a small orifice, and the orifice region having a radius of curvature being matched or adapted to the given radius of curvature.

The effect of the structure according to the invention is that the individual fibers, which are delivered in the fiber guide channel shortly before being fed onto the slide wall of the spinning rotor, are turned into the feed direction, or in other words into the direction of spinning rotor revolution, and aligned. Then the fibers are fed to the slide wall of the spinning rotor at an extremely flat angle.

In accordance with another feature of the invention, the cross section of the yarn guide channel narrows toward its small orifice. The resultant acceleration in the transporting air stream has a likewise positive effect on the individual fibers delivered in the fiber guide channel, since the fibers are put in a drafted position parallel to one another, or are kept in that position.

Moreover, aligning and collecting of the individual fibers being delivered is promoted by a special cross-sectional form of the fiber guide channel in the orifice region.

In accordance with a further feature of the invention, the the fiber guide channel has a cross-sectional form that has an inner semicircularly constructed region. Toward the top, in other words toward the outer radius of the curved channel segment, the fiber guide channel is formed in roof-shaped or gabled fashion, so that an outer fiber collecting groove that is approximately comparable to the fiber collecting groove of the rotor already appears in the fiber guide channel.

A first assembly of the parallel individual fibers being delivered already takes place in this fiber collecting groove of the fiber guide channel.

Although the cross-sectional form for the fiber guide channel described above, or an embodiment comparable to that cross-sectional form, is extremely advantageous, other cross-sectional forms are also possible in principle.

In accordance with an added feature of the invention, the cross section of the orifice region of the fiber guide channel disposed in the lid extension is semicircular or in the form of a sector of a circle. Other cross-sectional shapes are entirely conceivable, such as round, oval, elliptical or the like.

In accordance with a concomitant feature of the invention, the orifice region of the fiber guide channel is curved in the rotor rotation direction, in such a way that the fiber arrival point, that is the point at which the individual fibers wrap themselves onto the slide wall of the spinning rotor, is offset considerably in the direction of rotor revolution as compared with a corresponding fiber arrival point of a fiber guide channel having a straight orifice region. The angle of offset is between 60° and 180°, depending on the curvature of the orifice region. A curvature that leads to an offset angle of approximately 110° has proved particularly advantageous.

Other features which are considered as characteristic for the invention are set forth in the appended claims.

Although the invention is illustrated and described herein as embodied in an open-end spinning apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
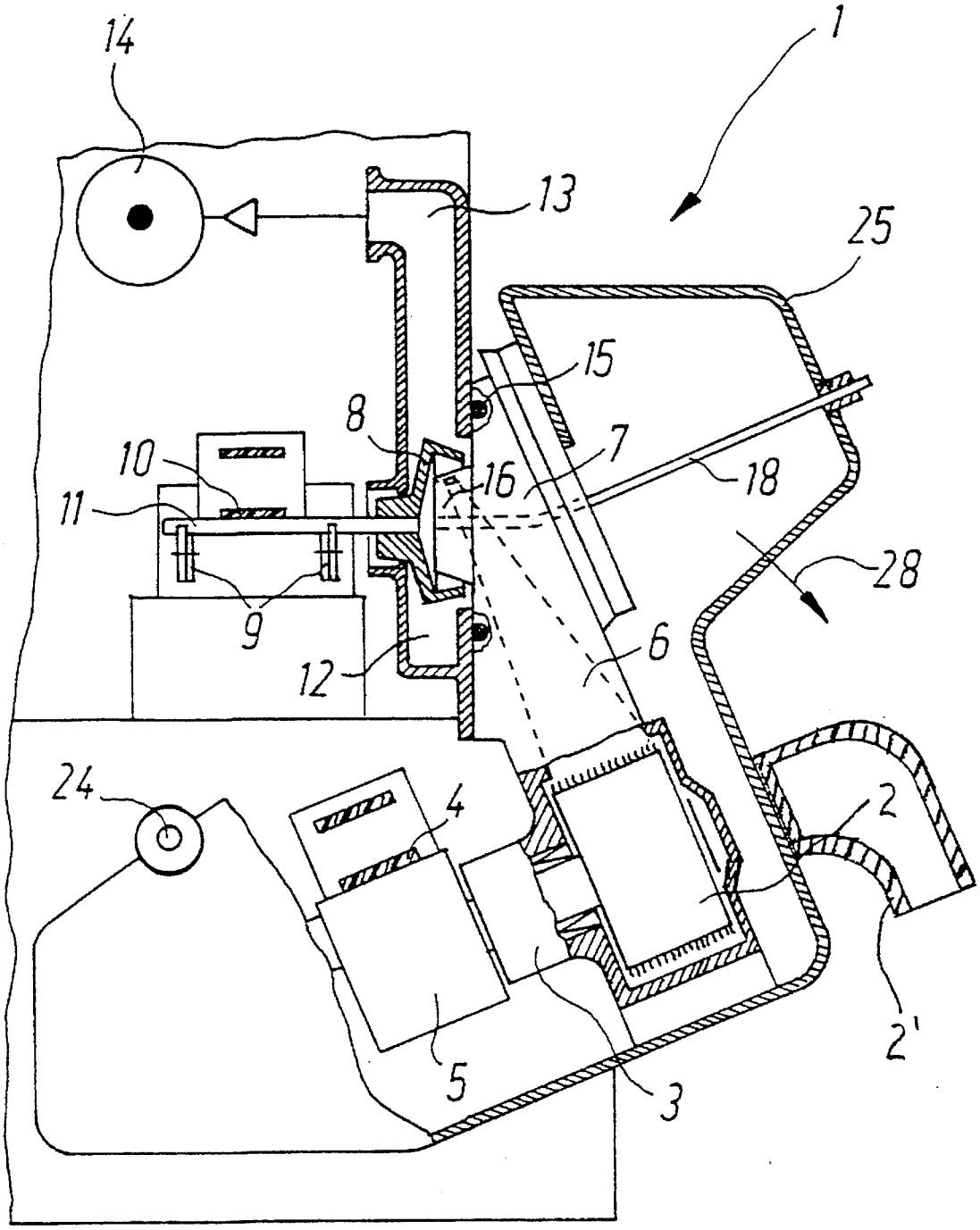
FIG. 1 is a fragmentary, diagrammatic, partly sectional view of a spinning station of an open-end spinning apparatus.

Referring now to the figures of the drawing in detail and first, particularly, to FIG. 1 thereof, there is seen one spinning unit of an open-end spinning apparatus. Spinning machines of this kind, as is well known, have a number of such individually drivable spinning units, disposed next to one another.

These spinning units 1 are supplied with sliver through a fiber feed device 2' in a known manner. The sliver is placed in spinning cans that are deposited in front of the spinning stations. The fiber feed device 2' delivers the sliver to a fiber separating element, such as a studded fiber separating roller 2 as shown.

The fiber separating roller 2 is supported in a bearing housing 3 and is acted upon, through wharves 5 disposed on its ends, by a machine-length revolving tangential belt 4.

Individual fibers that are combed out from the presented sliver by the fiber separating roller 2, are transferred pneumatically to a spinning system through a fiber guide channel 6.

Figure 2:
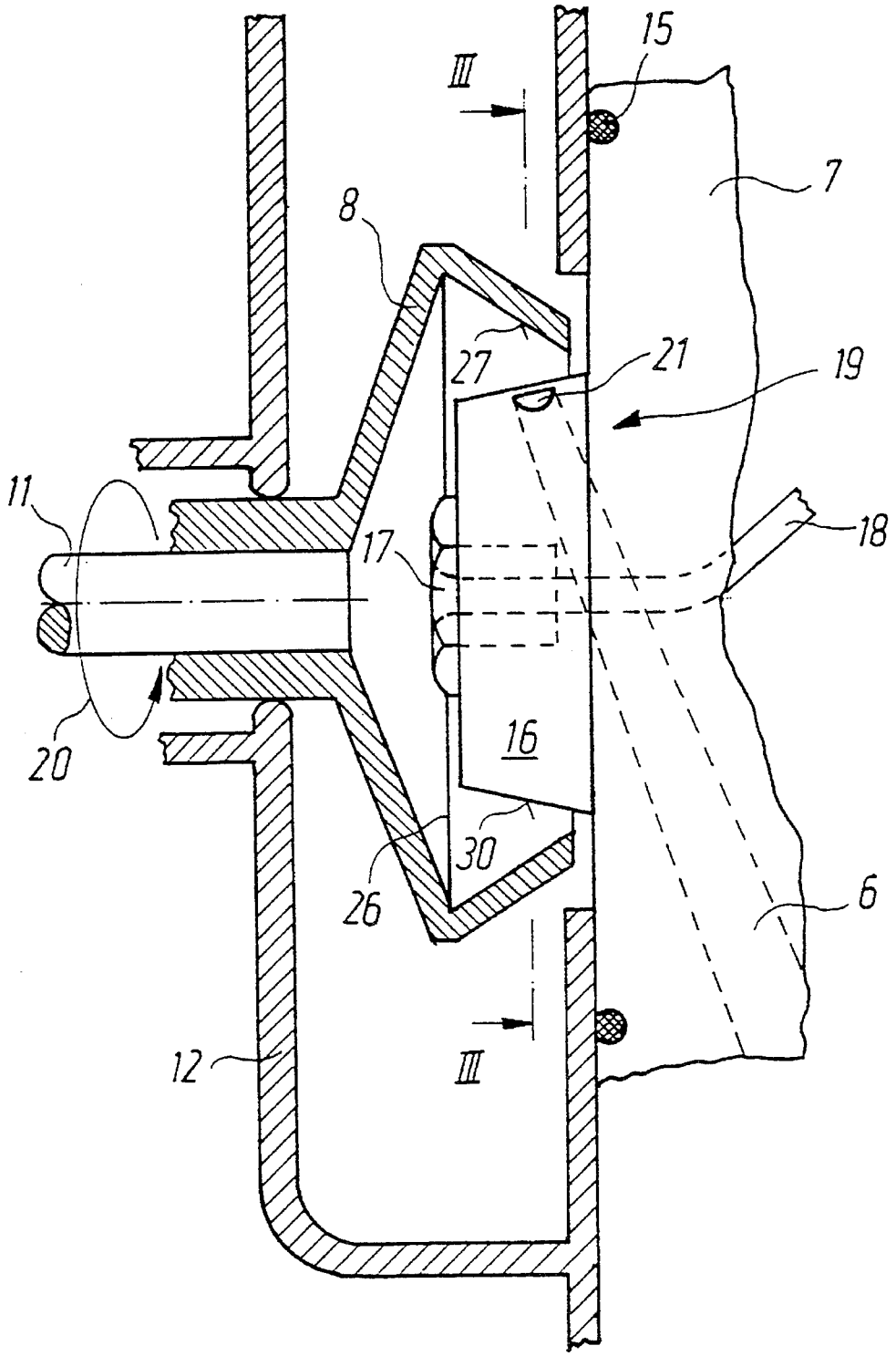
FIG. 2 is an enlarged, fragmentary, sectional view of a lid extension having a fiber guide channel and extending into the spinning rotor.

The spinning system includes a spinning rotor 8 which is supported by a shaft 11 thereof in a support disk bearing 9. Similarly to the wharve of the fiber separating roller, the shaft 11 of the spinning roller 8 is driven by a machine-linked tangential belt 10. The spinning rotor 8 runs inside a rotor housing 12, which is connected to a negative pressure or suction source 14 through a connection piece 13 and is closed toward the open side of the rotor by a lid or cap 7 with an O-ring 15. The lid 7 also has a lid extension 16, which protrudes part way into the spinning rotor 8 and in the middle of which a yarn draw-off nozzle 17 of a yarn draw-off tube 18 is disposed, as is best seen in FIG. 2. As FIG. 1 especially shows, the lid 7 is secured to a cover 25 that can be folded out of the way in the direction of an arrow 28 and in the folded-away state provides access to the rotor housing 12 and to the spinning rotor 8. As is suggested in the drawings, the cover 25 is either retained with a limited capacity for rotation in a pivot bearing 24 and can be pivoted out of the way together with the fiber separating unit, or it is supported in a separate pivot bearing and then can be folded out of the way separately.

It has already been mentioned above that the spinning rotor 8 is joined to the fiber separating roller 2 through the fiber guide channel 6. This fiber guide channel 6 ends in a peripheral surface 30 of the lid extension 16, as is seen in FIG. 2. The lid extension 16 may either, as shown, have a frustoconical contour, or be constructed as a truncated cylinder, or have a conicity similar to that of a fiber slide wall 27.

Figure 3:
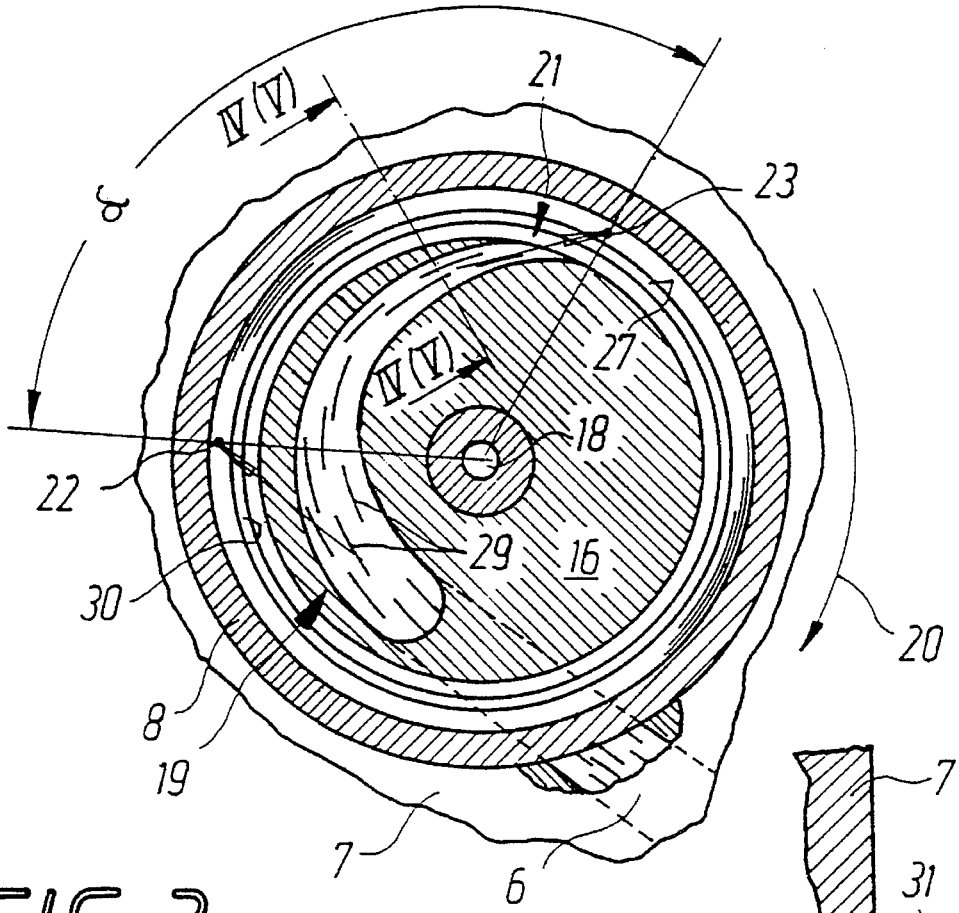
FIG. 3 is a fragmentary, partly sectional front view of the lid extension, taken along a section line III—III of FIG. 2, in the direction of the arrows.
Figure 4:
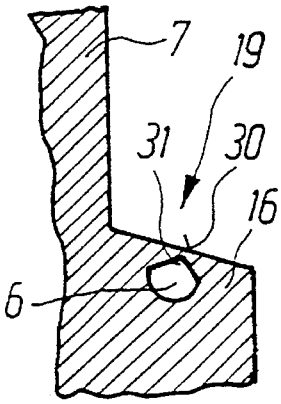
FIG. 4 is a sectional view of a preferred cross-sectional form of the orifice region of the fiber guide channel, which is taken along a section line IV—IV of FIG. 3, in the direction of the arrows.
Figure 6:
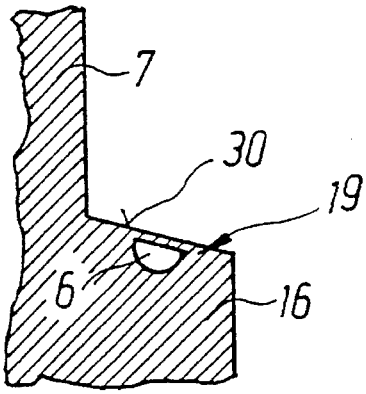
FIGS. 5 and 6 are sectional views of further cross-sectional forms of the orifice region of the fiber guide channel, which are taken along a section line V—V of FIG. 3, in the direction of the arrows.
Figure 5:
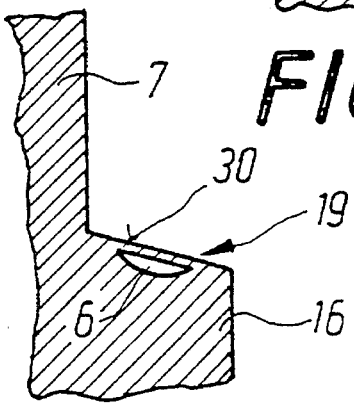

As is suggested in FIG. 2 and as can be seen from FIG. 3, an orifice region 19 of the fiber guide channel 6 is curved in a direction 20 of rotor rotation and ends in an orifice 21. As is seen in FIGS. 4, 5 and 6, in the orifice region 19, the fiber guide channel 6 has a cross section that is preferably semicircular or in the form of a sector of a circle in a lower region. Toward the top, or in other words toward the radius of the fiber guide channel, it comes to an end in roof-shaped or gabled fashion in a fiber collecting groove 31 seen in FIG. 4. However, other cross-sectional forms are also possible, such as semicircular or circular sector-like, round, oval, elliptical, or similar forms.

The fiber guide channel 6 tapers continuously in its orifice region 19 and has its smallest diameter in the region of the orifice 21.

The curvature of the orifice region 19 in the direction of the arrow 20 leads to an offset of a fiber arrival point 23 in the direction 20 of rotor rotation. An offset angle $\alpha$ (referred to a fiber arrival point 22 that is established when the orifice region of the fiber guide channel is straight) is between 60° and 180°. An offset angle $\alpha$ of approximately 110° has proved especially advantageous.

Function of the Apparatus

The negative pressure source 14 produces a negative pressure or suction in the rotor housing 12 in which the spinning rotor 8 revolves. This creates a transporting flow in the fiber guide channel 6 toward the spinning rotor 8. This transporting flow carries individual fibers 29 which are combed out of sliver by the fiber separating roller 2, onto the fiber slide wall 27 of the spinning rotor 8. The fibers 29 then slide into a fiber collecting groove 31 of the rotor 8, and from there are removed in the form of spun yarns through the draw-off nozzle 17 of a yarn draw-off tube 18.

The curvature according to the invention as well as the cross-sectional form of the orifice region 19 of the fiber guide channel 6 result in the individual fibers 29 that are aligned substantially parallel, being already combined in the fiber guide channel 6 into a fiber stream, and arriving at the fiber slide wall 27 at the fiber arrival point 23 at an extremely flat angle. Since the orifice region 19 of the fiber guide channel 6 narrows toward its orifice 21, the transporting air stream is also accelerated further in this region, so that despite their reflection and their being joined together, the fibers 29 are aligned or remain aligned.

Experiments have shown that with open-end spinning apparatuses having fiber guide channels which have the above-described characteristics in the orifice region, the yarn qualities can be increased considerably.

In particular, yarns that are produced in open-end spinning apparatuses constructed in this way have markedly higher strength values, because of the good fiber guidance in the orifice region, and because of the extremely flat arrival angle of the fibers at the fiber slide wall.

I claim:

1. An open-end spinning apparatus, comprising:

a feed device for supplying sliver;

a device downstream of said feed device for separating the sliver into individual fibers;

a fiber guide channel downstream of said fiber separating device for pneumatically transferring the individual fibers;

a spinning rotor downstream of said fiber guide channel for rotating in a given direction and receiving the individual fibers, said spinning rotor having a fiber slide wall and said fiber slide wall having a given radius of curvature; and a lid closing said spinning rotor and having a centrally disposed yarn draw-off tube and a lid extension;

said fiber guide channel having an end region extending in said lid extension and being curved in said given direction, said end region having an orifice region disposed in said lid extension, said orifice region being a curved channel segment terminating in a small orifice, and said orifice region having a radius of curvature being matched to said given radius of curvature.

2. The open-end spinning apparatus according to claim 1, wherein said fiber guide channel has a cross section ending in said lid extension and being tapered toward said orifice.

3. The open-end spinning apparatus according to claim 1 or 2, wherein said fiber guide channel has a cross section ending in said lid extension and having a fiber guide channel wall, said fiber guide channel wall having a cross section corresponding to an arc of an ellipsis.

4. The open-end spinning apparatus according to claim 1, wherein said fiber guide channel formed in said lid extension has a cross-section which is semicircular in one region and roof-shaped in another region defining a fiber collecting groove.

5. The open-end spinning apparatus according to claim 1, wherein said fiber guide channel formed in said lid extension has a cross-section which is a sector of a circle in one region and roof-shaped in another region defining a fiber collecting groove.

6. The open-end spinning apparatus according to claim 1, wherein said fiber guide channel has a cross section ending in said lid extension and being semicircular.

7. The open-end spinning apparatus according to claim 1, wherein said fiber guide channel has a cross section ending in said lid extension and being a sector of a circle.

8. The open-end spinning apparatus according to claim 1, wherein said fiber guide channel has a cross section ending in said lid extension and having a fiber guide channel wall, said fiber guide channel wall having a cross section corresponding to an arc of a circle.

9. The open-end spinning apparatus according to claim 1, wherein said fiber guide channel has a cross section ending in said lid extension and having a fiber guide channel wall, said fiber guide channel wall having a cross section corresponding to an arc of an oval.

10. The open-end spinning apparatus according to claim 1, wherein the fibers arrive at a fiber arrival point on said fiber slide wall downstream of said curved orifice region, and said fiber arrival point is offset from an imaginary fiber arrival point downstream of a straight line of the fiber guide channel upstream to its curvature, by an angle between 60° and 180°, as seen in said given direction.

11. The open-end spinning apparatus according to claim 10, wherein said offset angle is approximately 110°.

* * * * *